US011047207B2

(12) United States Patent
Janes et al.

(10) Patent No.: US 11,047,207 B2
(45) Date of Patent: Jun. 29, 2021

(54) CONTROLLING THE SENSITIVITY OF A VALVE BY ADJUSTING A GAP

(71) Applicant: HALLIBURTON ENERGY SERVICES, INC., Houston, TX (US)

(72) Inventors: Stephen Christopher Janes, Houston, TX (US); Neelesh V. Deolalikar, Houston, TX (US); Daniel Winslow, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/321,529

(22) PCT Filed: Dec. 30, 2015

(86) PCT No.: PCT/US2015/068189
§ 371 (c)(1),
(2) Date: Dec. 22, 2016

(87) PCT Pub. No.: WO2017/116448
PCT Pub. Date: Jul. 6, 2017

(65) Prior Publication Data

US 2018/0038197 A1 Feb. 8, 2018

(51) Int. Cl.
*E21B 34/06* (2006.01)
*E21B 7/06* (2006.01)
(Continued)

(52) U.S. Cl.
CPC ..... *E21B 34/06* (2013.01); *E21B 7/061* (2013.01); *E21B 21/103* (2013.01); *E21B 4/02* (2013.01); *E21B 7/04* (2013.01)

(58) Field of Classification Search
CPC ..... E21B 4/02; E21B 34/06; E21B 44/005; E21B 21/103; E21B 7/04; E21B 7/061;
(Continued)

(56) References Cited

U.S. PATENT DOCUMENTS 2,941,401 A * 6/1960 Streeter ..... G01F 1/26 137/517
3,739,331 A 6/1973 Godbey et al.
(Continued)

FOREIGN PATENT DOCUMENTS

EP 2087202 2/2012
GB 819866 9/1959
(Continued)

OTHER PUBLICATIONS

PCT International Search Report & Written Opinion, dated Sep. 13, 2016, Appl No. PCT/US2015/068189, "Controlling the Sensitivity of Valve by Adjusting Gap," Filed Dec. 30, 2015, 10 pgs.
(Continued)

*Primary Examiner* — George S Gray
(74) *Attorney, Agent, or Firm* — Benjamin Ford; Parker Justiss, P.C.

(57) ABSTRACT

A downhole tool including multiple orifices defining at least a first and a second flow path, and a valve that adjusts to change a ratio of fluid flow between the first and second flow paths, the valve being offset from the multiple orifices by a gap that is adjustable to customize a sensitivity of the change to each adjustment. A method for regulating flow along a first fluid path in a downhole tool includes adjusting a valve relative to multiple orifices that define the first fluid path and a second fluid path, said adjusting changing a ratio of fluid flow between the first and second flow paths, and adjusting a gap between the valve and the multiple orifices to modify a sensitivity of the change to each adjustment.

18 Claims, 9 Drawing Sheets

(51) Int. Cl.

| | |
|---|---|
| ***E21B 21/10*** | (2006.01) |
| ***F16K 11/00*** | (2006.01) |
| *E21B 4/02* | (2006.01) |
| *E21B 7/04* | (2006.01) |

(58) Field of Classification Search

CPC .... E21B 21/10–106; E21B 21/00; F16K 3/04; F16K 1/00; F16K 1/12; F16K 11/00

USPC ..... 251/117, 121, 122, 318, 301; 137/599.09–599.13, 601.18, 861, 872, 137/876

See application file for complete search history.

(56) References Cited

U.S. PATENT DOCUMENTS

| | | | | |
|---|---|---|---|---|
| 3,770,006 | A | 11/1973 | Sexton et al. | |
| 4,630,244 | A | 12/1986 | Larronde | |
| 5,174,392 | A * | 12/1992 | Reinhardt | E21B 4/02 175/107 |
| 5,176,164 | A | 1/1993 | Boyle | |
| 5,738,178 | A * | 4/1998 | Williams | E21B 4/02 175/61 |
| 5,826,612 | A | 10/1998 | Goates | |
| 8,668,204 | B2 | 3/2014 | Reeb et al. | |
| 2008/0236839 | A1 | 10/2008 | Oddie | |
| 2011/0266001 | A1 | 11/2011 | Dykstra et al. | |
| 2012/0119127 | A1 | 5/2012 | Tower | |
| 2012/0160565 | A1 | 6/2012 | Downton et al. | |
| 2012/0187219 | A1 | 7/2012 | Ciriscone, II et al. | |
| 2013/0250728 | A1 | 9/2013 | Burgess | |

FOREIGN PATENT DOCUMENTS

| | | | |
|---|---|---|---|
| WO | 2013/074070 | 5/2013 | |
| WO | WO-2015126399 A1 * | 8/2015 | E21B 4/006 |

OTHER PUBLICATIONS

"Introduction to Fluid Mechanics," by William S. Janna, Fox and McDonald, Fifth Edition, sections 8-10, Sep. 18, 2015, 769 pages, Abstract only submitted.

* cited by examiner

CONTROLLING THE SENSITIVITY OF A VALVE BY ADJUSTING A GAP

BACKGROUND

Boreholes, which are also commonly referred to as "wellbores" and "drill holes," are created for a variety of purposes, including exploratory drilling for locating underground deposits of different natural resources, mining operations for extracting such deposits, and construction projects for installing underground utilities. A common misconception is that all boreholes are vertically aligned with the drilling rig; however, many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Conventional directional boring techniques traditionally operate from a boring device that pushes or steers a series of connected drill pipes with a directable drill bit at the distal end thereof to achieve the borehole geometry. In the exploration and recovery of subsurface hydrocarbon deposits, such as petroleum and natural gas, the directional borehole is typically drilled with a rotatable drill bit that is attached to one end of a bottom hole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often comprising jointed pipe or relatively flexible "spoolable" tubing, also known as "coiled tubing." This directional drilling system—i.e., the operatively interconnected tubing, drill bit, and BHA—can be referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Directional drilling typically requires controlling and varying the direction of the wellbore as it is being drilled. Oftentimes the goal of directional drilling is to reach a position within a target subterranean destination or formation with the drill string. For instance, the drilling direction may be controlled to direct the wellbore towards a desired target destination, to control the wellbore horizontally to maintain it within a desired payzone, or to correct for unwanted or undesired deviations from a desired or predetermined path. Frequent adjustments to the direction of the wellbore are often necessary during a drilling operation, either to accommodate a planned change in direction or to compensate for unintended or unwanted deflection of the wellbore. Unwanted deflection may result from a variety of factors, including the characteristics of the formation being drilled, the makeup of the bottomhole drilling assembly, and the manner in which the wellbore is being drilled, as some non-limiting examples.

Various options are available for providing steering capabilities to a drilling tool for controlling and varying the direction of the wellbore. In directional drilling applications, for example, one option is to attach a bent-housing or a bent-sub downhole drilling motor to the end of the drilling string as a steering tool. When steering is required, the drill-pipe section of the drilling string can be restrained against rotation and the drilling motor can be pointed in a desired direction and operated for both drilling and steering in a "sliding drilling" mode. When steering is not required, the drilling string and the drilling motor can be rotated together in a "rotary drilling" mode. An advantage to this option is its relative simplicity. One disadvantage to this option, however, is that steering is typically limited to the sliding drilling mode. In addition, the straightness of the borehole in rotary drilling mode may be compromised by the presence of the bent drilling motor. Furthermore, since the drill pipe string is not rotated during sliding drilling, it is more susceptible to sticking in the wellbore, particularly as the angle of deflection of the wellbore from the vertical increases, resulting in reduced rates of penetration.

Directional drilling may also be accomplished with a "rotary steerable" drilling system wherein the entire drill pipe string is rotated from the surface, which in turn rotates the bottom hole assembly, including the drilling bit, connected to the end of the drill pipe string. In a rotary steerable drilling system, the drilling string may be rotated while the drilling tool is being steered either by being pointed or pushed in a desired direction (directly or indirectly) by a steering device. Some rotary steerable drilling systems include a component which is non-rotating relative to the drilling string in order to provide a reference point for the desired direction and a mounting location for the steering device(s). Alternatively, a rotary steerable drilling system may be "fully rotating". Drilling fluids are often used to drive the various parts of the drilling system, including turbines and mud motors used within.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to one having ordinary skill in the art and having the benefit of this disclosure.

DETAILED DESCRIPTION

Flow Splitting

Figure 1:
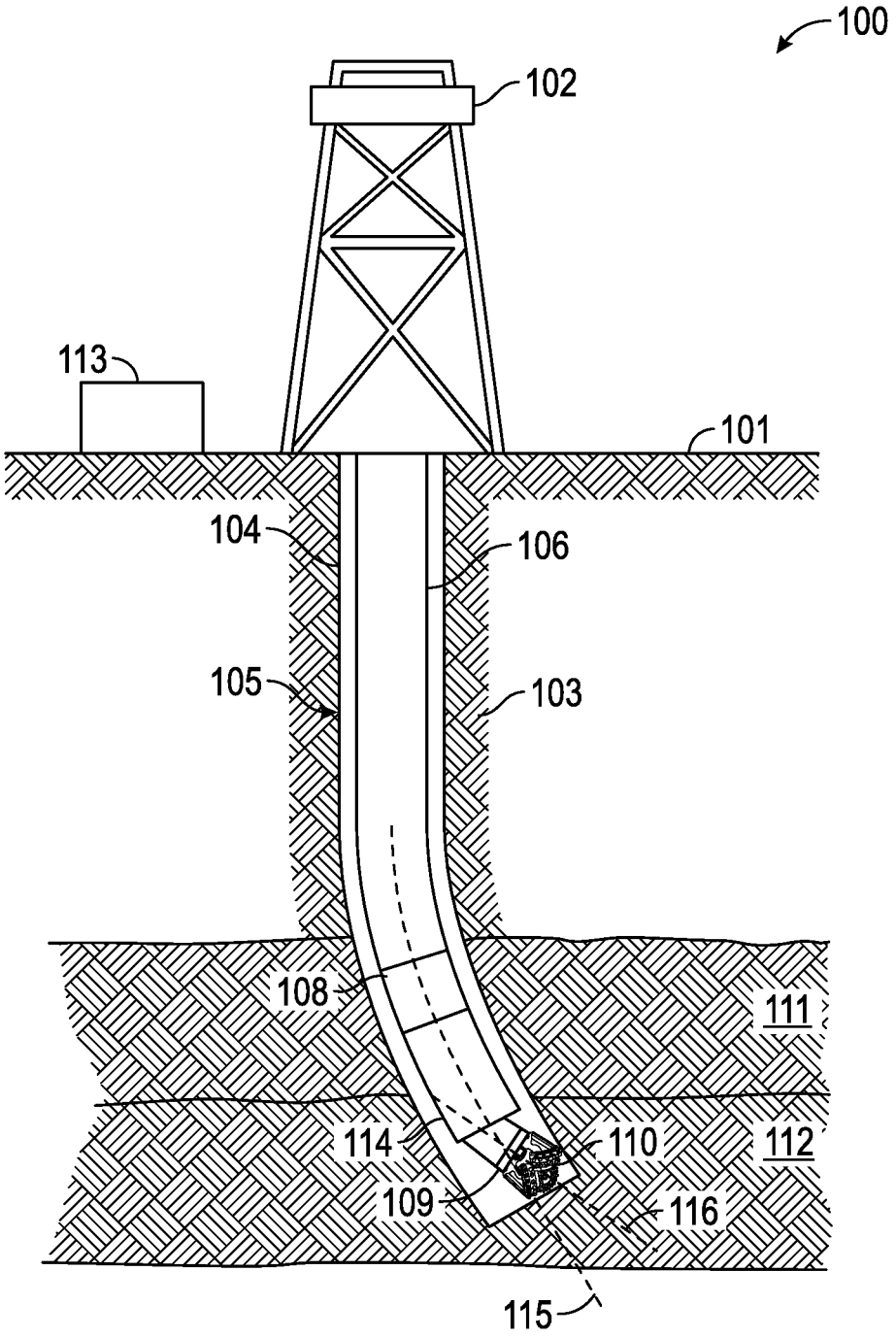
FIG. 1 is a diagram of a drilling system according to embodiments of the disclosure.

The present disclosure relates to controlling the flow rates through a valve in a downhole tool that requires a certain flow rate of drilling mud to operate. Different portions of the tool may require more flow than others. In an embodiment, a shear valve may be used to distribute the mud flow to the various portions of the downhole tool. For example, if the tool as a whole requires between 400 GPM and 800 GPM, a turbine within the tool may only require between 50 GPM and 200 GPM. Thus, when pumping 800 GPM through the tool, the maximum flow the shear valve can be supplying to the turbine is 25% of the total flow, and when pumping 400 GPM, the shear valve needs to supply a maximum of 50% of the total flow to the turbine. To use the full rotation of the shear valve when pumping 800 GPM, a smaller gap, for example about 32 mm is needed, and a gap greater than about 80 mm is needed when pumping at 400 GPM.

Generally, an "orifice" as used in this disclosure is a change in flow area whose pressure drop may be approximated by standard orifice calculations as described in Section 8-10 of *Introduction to Fluid Mechanics*, by Fox & McDonald, Fifth Edition.

Embodiments of the present invention disclose that if the valve gap is small, a change in the valve angle may result in a larger change in the flow fraction than if the valve gap is larger with the same change in the valve angle. Thus, adjusting the valve gap may allow a larger tool flow range and may increase the effectiveness of the shear valve.

In an embodiment, a downhole tool comprises a tool body, multiple orifices in the tool body defining at least a first and a second flow path; and a valve that adjusts to change a ratio of fluid flow between the first and second flow paths, the valve being offset from the multiple orifices by a gap that is adjustable to customize a sensitivity of the change to each adjustment. The tool may further comprise a turbine, wherein the first path of the valve is in fluid communication with the turbine. The valve type may be one selected from the group consisting of gate, shear, globe, and poppet. In a preferred embodiment, the valve is a poppet valve. In exemplary embodiments, the gap is adjustable using at least one of a manual adjustment, an active adjustment, an automatic adjustment, and combinations thereof. The manual adjustments may be made using shims. In the actively adjusting embodiments, springs may be used to passively adjust the gap. If automatic adjusting of the gap is desired, an actuator may be used. In some embodiments, a smaller valve gap results in greater shear valve sensitivity than a relatively larger valve gap.

In another embodiments, a method for regulating flow along a first fluid path in a downhole tool comprises adjusting a valve relative to multiple orifices that define the first fluid path and a second fluid path, said adjusting including changing a ratio of fluid flow between the first and second flow paths; and adjusting a gap between the valve and the multiple orifices to modify a sensitivity of the change.

Yet another embodiment is directed to a system for regulating flow along a first fluid path, the system comprising: a downhole tool including: a valve coupled to multiple orifices that define the first fluid path and a second fluid path and a gap between the valve and the multiple orifices; said tool configured to adjust the valve relative to the multiple orifices, said adjustment including changing a ratio of fluid flow between the first and second flow paths; and adjust the gap between the valve and the multiple orifices to modify a sensitivity of the change. The system may further include a turbine, wherein the first path of the valve is in fluid communication with the turbine.

Drilling Systems

FIG. 1 is a general diagram illustrating an example drilling system 100, according to embodiments of the present disclosure. The drilling system 100 includes rig 102 mounted at the surface 101 and positioned above borehole 104 within a subterranean formation 103. In the embodiment shown, a drilling assembly 105 may be positioned within the borehole 104 and may be coupled to the rig 102. The drilling assembly 105 may comprise drill string 106 and bottom hole assembly (BHA) 107. The drill string 106 may comprise a plurality of segments threadedly connected. The BHA 107 may comprise a drill bit 109, a measurement-while-drilling (MWD) apparatus 108 and a steering assembly 114. The steering assembly 114 may control the direction in which the borehole 104 is being drilled. As will be appreciated by one of ordinary skill in the art in view of this disclosure, the borehole 104 will be drilled in the direction perpendicular to the tool face 110 of the drill bit 109, which corresponds to the longitudinal axis 116 of the drill bit 109. Accordingly, controlling the direction of the borehole 104 may include controlling the angle between the longitudinal axis 116 of the drill bit 109 and longitudinal axis 115 of the steering assembly 114, and controlling the angular orientation of the drill bit 109 relative to the formation 103.

The steering assembly 114 may include an offset mandrel (not shown) that causes the longitudinal axis 116 of the drill hit 109 to deviate from the longitudinal axis 115 of the steering assembly 114. The offset mandrel may be counter-rotated relative to the rotation of the drill string 106 to maintain an angular orientation of the drill bit 109 relative to the formation 103. The steering assembly 114 may receive control signals from a control unit 113. The control unit 113 may comprise an information handling system with a processor and a memory device, and may communicate with the steering assembly 114 via a telemetry system. The control unit 113 may transmit control signals to the steering assembly 114 to alter the longitudinal axis 115 of the drill bit 109 as well as to control counter-rotation of portions of the offset mandrel to maintain the angular orientation of the drill bit 109 relative to formation 103. As used herein, maintaining the angular orientation of a drill bit relative to formation 103 may be referred to as maintaining the drill bit in a "geostationary" position. In certain embodiments, a processor and memory device may be located within the steering assembly 114 to perform some or all of the control functions. Moreover, other BHA 107 components, including the MWD apparatus 108, may communicate with and receive instructions from control unit 113.

Figure 2A:
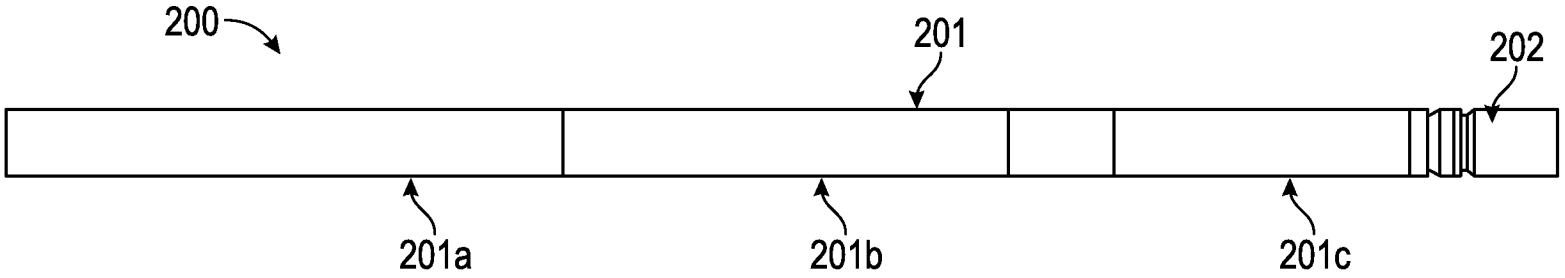
FIGS. 2A-C are diagrams illustrating an example steering assembly according to embodiments of the disclosure.
Figure 2B:
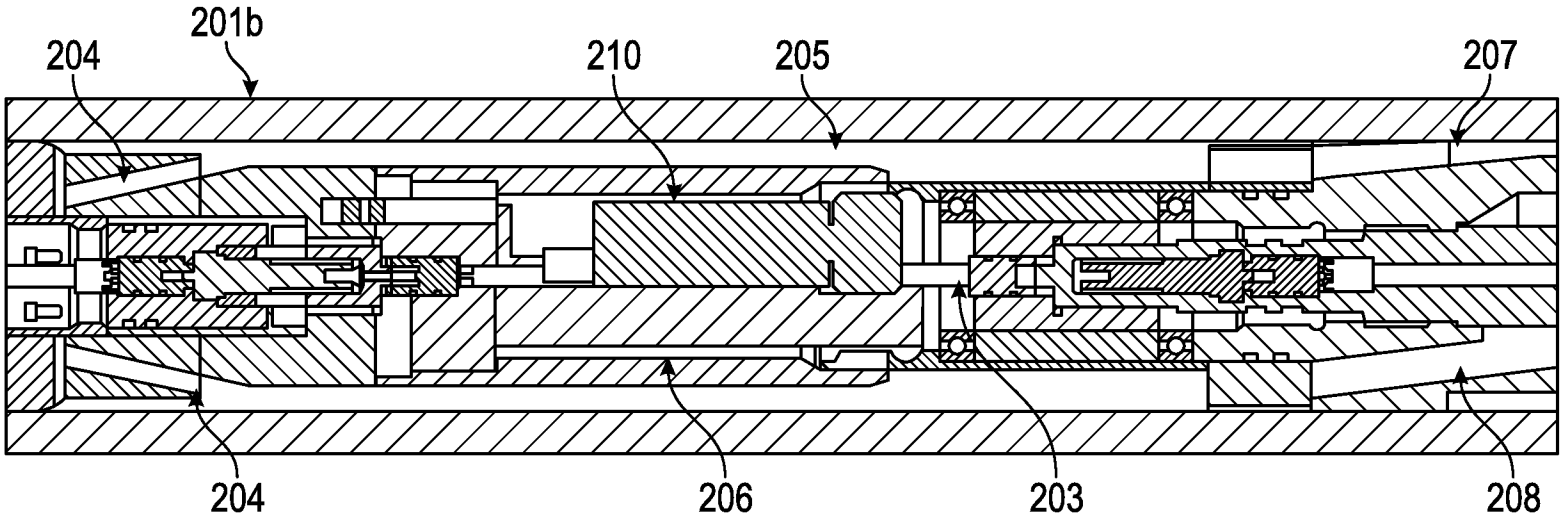
Figure 2C:
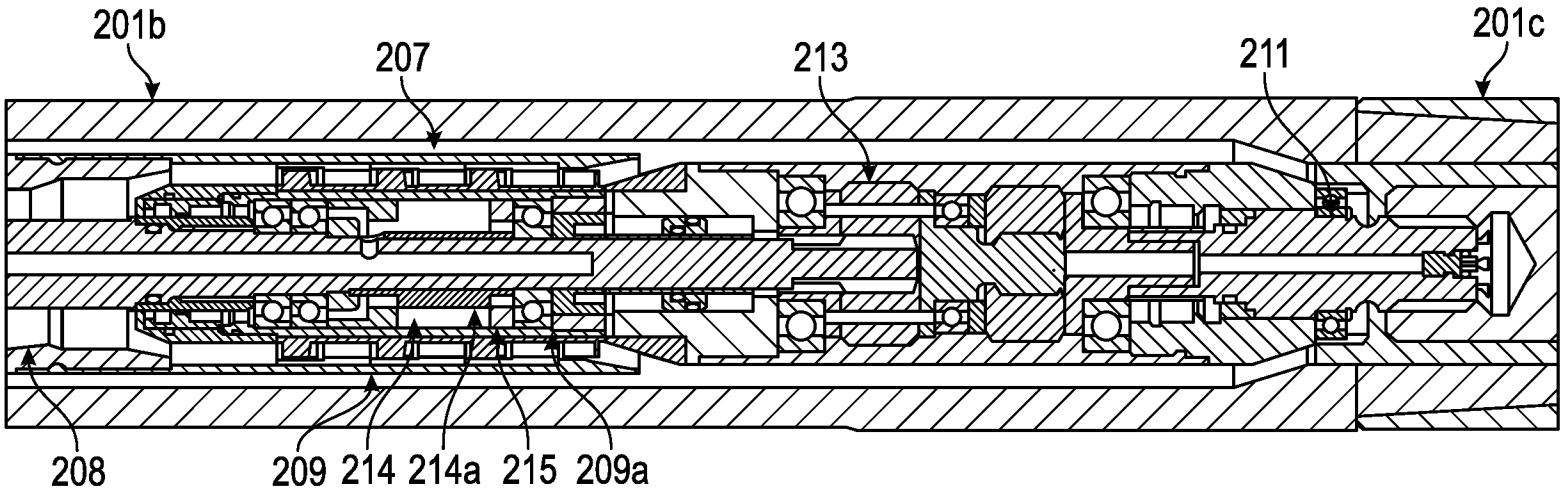

FIGS. 2A-C are diagrams illustrating an example steering assembly 200, according to embodiments of the present disclosure, that may be used, in part, to maintain a drill bit in a geostationary position during drilling operations. FIGS. 2B-C depict illustrative portions of the steering assembly 200. The steering assembly 200 may include a housing 201 that may be coupled directly to a drill string or indirectly to a drill string, such as through a MWD apparatus. The housing 201 may comprise separate segments 201*a-c*, or may comprise a single unitary housing. Section 201*a* may house the control mechanisms, and may communicate with a control unit at the surface and/or receive control signals from the surface and control mechanisms within the steering assembly. Section 201*b* may comprise drive elements, including a variable flow pathway and a flow-controlled drive mechanism. Section 201*c* may comprise steering elements that control the drilling angle and axial orientation of a drill bit coupled to bit shaft 202 of the steering assembly 200.

In certain embodiments, the steering assembly 200 may be coupled, directly or indirectly, to a drill string, through which drilling fluid may be pumped during drilling operations. The drilling fluid may flow through ports 204 into an annulus 205 around a flow control module 206. Once in the annulus 205, the drilling fluid may either flow to an inner annulus 208, in fluid communication with a fluid-controlled drive mechanism 209, or may be diverted to a bypass annulus 207. A flow control valve 210 may be included within the flow control module 206 and may control the amount/flow of drilling fluid that enters the inner annulus 208 to drive the fluid-controlled drive mechanism 209.

In certain embodiments, the fluid pathway from port 204 to inner annulus 208 may comprise a variable flow fluid pathway 203, with the fluid-controlled drive mechanism 209 being in fluid communication with the variable flow fluid pathway 203 via inner annulus 208. The flow control valve 210 may be disposed within the variable flow fluid pathway 203, and configured to vary or change the fluid flow through the variable flow fluid pathway 203. The rotational speed of the fluid-controlled drive mechanism 209 may be controlled by the amount and rate of drilling fluid that flows into the inner annulus 208. In certain embodiments, the flow control valve 210, therefore, may be used to control the rotational speed of the fluid-controlled drive mechanism 209 by varying the amount or rate of drilling fluid that flows into the inner annulus 208. As would be appreciated by one of ordinary skill in the art in view of this disclosure, other variable flow fluid pathways are possible, using a variety of valve configurations that may meter the flow of drilling fluid across a fluid-controlled drive mechanism.

As described above, the steering assembly 200 may comprise a fluid-controlled drive mechanism 209 in fluid communication with the variable flow fluid pathway 203 via the inner annulus 208. In the embodiment shown, the fluid-controlled drive mechanism 209 comprises a turbine, but other fluid-controlled drive mechanisms are possible, including but not limited to a mud motor. The turbine 209 may comprise a plurality of rotors and stators that generate rotational movement in response to fluid flow within the inner annulus 208. The turbine 209 may generate rotation at an output shaft 211. In the embodiment shown, a speed reducer 213 may be placed between the turbine 209 and the output shaft 211 to reduce the rate of rotation generated by the turbine 209.

In certain embodiments, a generator 214 may be coupled to the fluid-controlled drive mechanism 209. In the embodiment shown, the generator 214 may be magnetically coupled to a rotor 209*a* of the turbine 209. The generator 214 may comprise a wired stator 214*a*. The wired stator 214*a* may be magnetically coupled to a rotor 209*a* of the rotor 209 via magnets 215 coupled to the rotor 209*a*. As the turbine 209 rotates, so does the rotor 209*a*, which may cause the magnets 215 to rotate around the wired stator 214*a*. This may generate an electrical current within the generator 214, which may be used to power a variety of control mechanisms and sensors located within the steering assembly 200, including control mechanisms within segment 201*a*.

Valves

Figure 3:
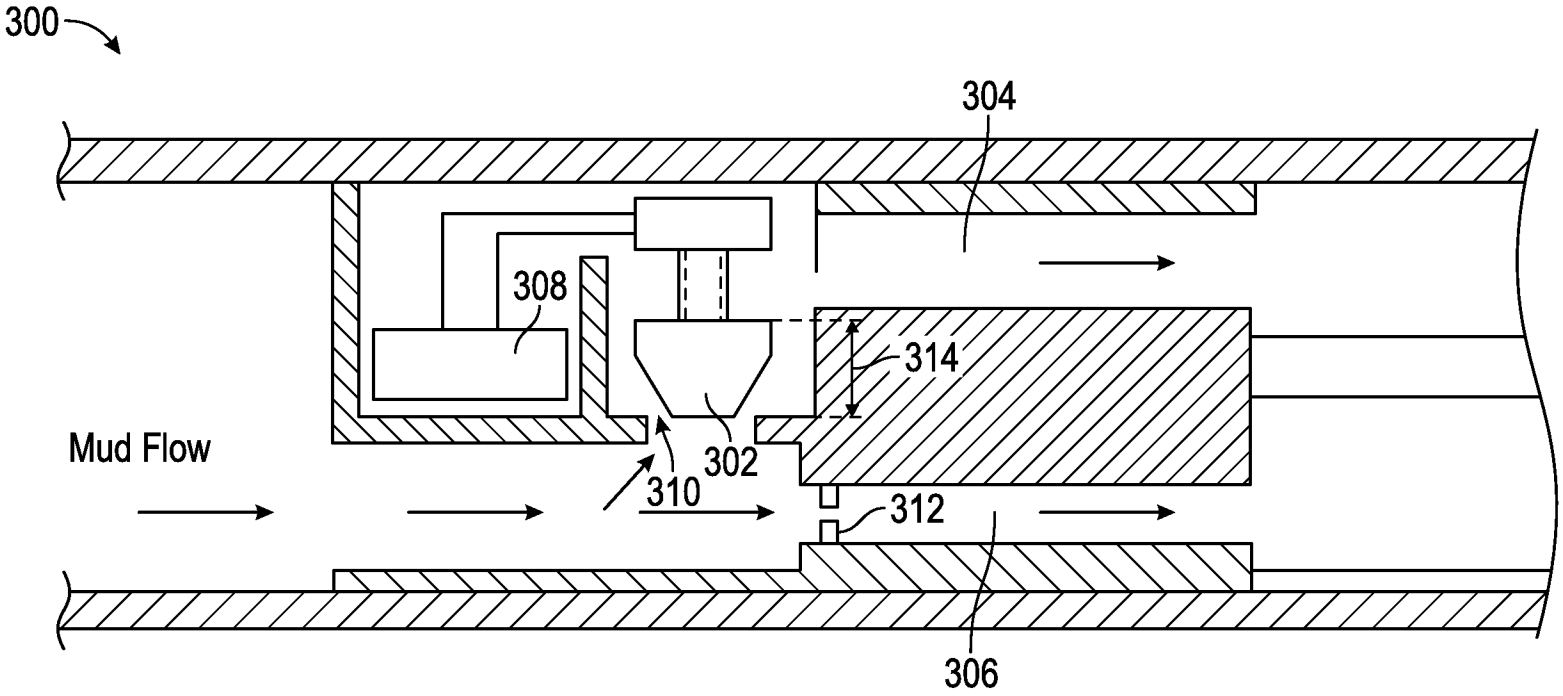
FIG. 3 illustrates a valve assembly according to embodiments of the invention.

The valves of the present disclosure may be any valve including gate, shear, globe, and poppet valves. The tool assembly 300 in FIG. 3, includes a valve 302, first flow path 304, and second flow path 306. As valve driver 308 adjusts valve 302, orifice 310 is exposed more or is closed off, depending upon the amount of flow needed. One of skill in the art will realize that as the orifice's exposure to the flow channel increases in size, for a given pressure, more flow may be admitted. Additionally, there is a nozzle 312 in fluid communication with the second flow path 306. As the valve 302 adjusts, the orifice's 310 exposure may grow in size, thereby increasing the flow in the first flow path 304, and decreasing the flow in the second flow path 306. The sensitivity of the valve 302 may be changed by adjusting the gap 314, which is how far the valve body travels into orifice 310.

Figure 4:
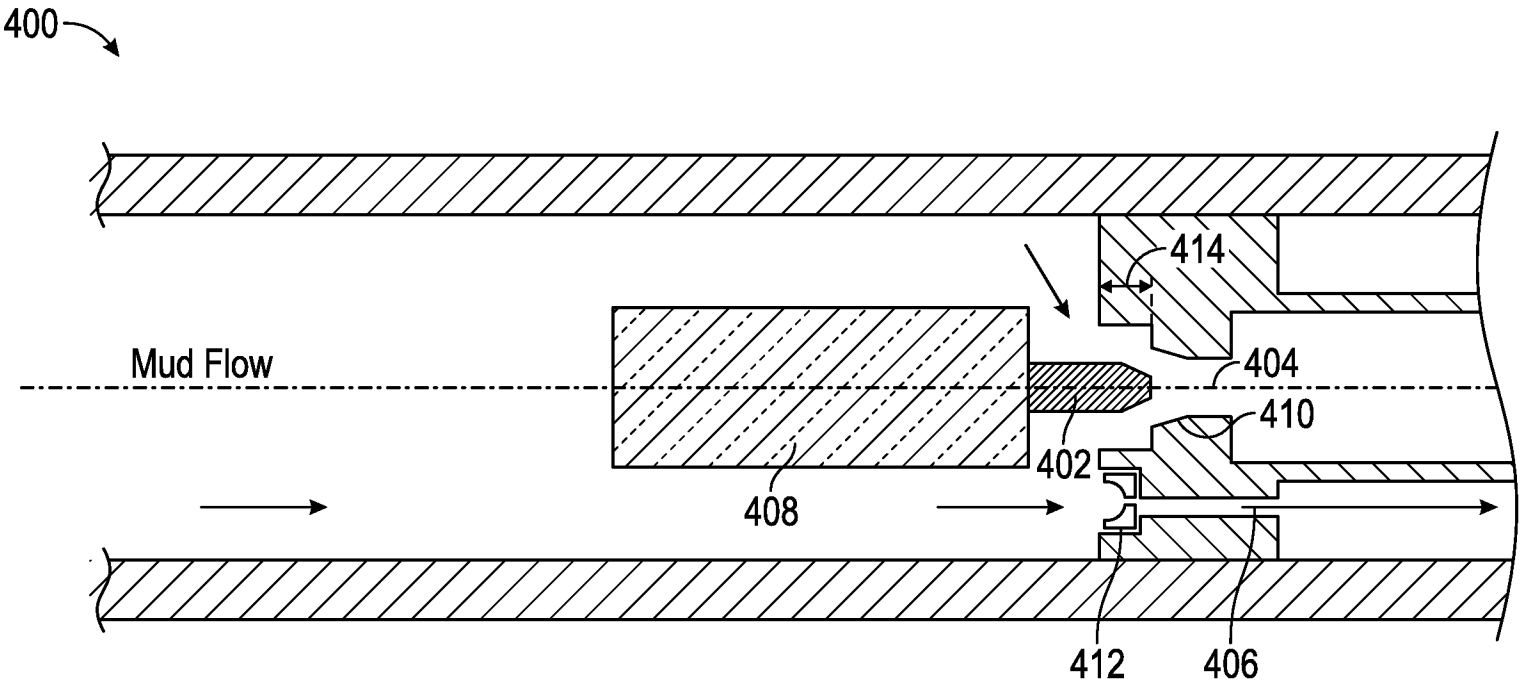
FIG. 4 illustrates a poppet valve assembly according to embodiments of the invention.

The tool assembly 400 in FIG. 4, includes a poppet valve 402, first flow path 404, and second flow path 406. As valve driver 408 adjusts poppet valve 402, orifice 410 is exposed more or is closed off, depending upon the amount of flow needed. One of skill in the art will realize that as the orifice's exposure to the flow channel increases in size, for a given pressure, more flow may be admitted. Additionally, there is a nozzle 412 in fluid communication with the second flow path 406. As the valve 402 adjusts, the orifice's 410 exposure may grow in size, thereby increasing the flow in the first flow path 404, and decreasing the flow in the second flow path 406. The sensitivity of the valve 402 may be changed by adjusting the gap 414 which is how far the valve body travels into orifice 410.

Shear Valves

Figure 5:
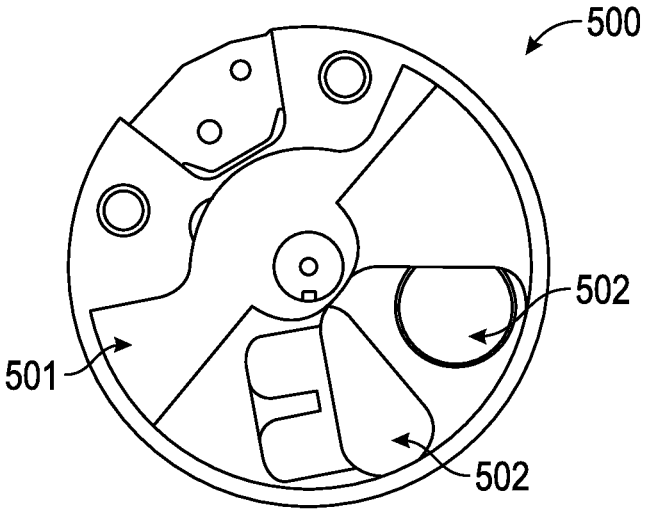
FIG. 5 illustrates a shear valve assembly according to embodiments of the invention.

The tool assembly 500 in FIG. 5, includes a shear valve 501 and orifices 502. As shear valve 501 rotates or swivels, the orifices 502 are exposed more or are closed off, depending upon the amount of flow needed. One of skill in the art will realize that as the orifice's exposure to the flow channel increases in size, for a given pressure, more flow may be admitted. As the shear valve 501 swivels, one orifice's exposure may grow in size, and one may reduce in size. It is also possible that both may be fully exposed, or fully covered. In an embodiment, the shear valve may be swiveled throughout the range of about 0 degrees to about 180 degrees in another embodiment, the shear valve may be swiveled throughout the range of about 0 degrees to about 85 degrees. In a preferred embodiment, the shear valve may swivel from about 10 degrees to about 75 degrees.

Gap Adjustments

Figure 6:
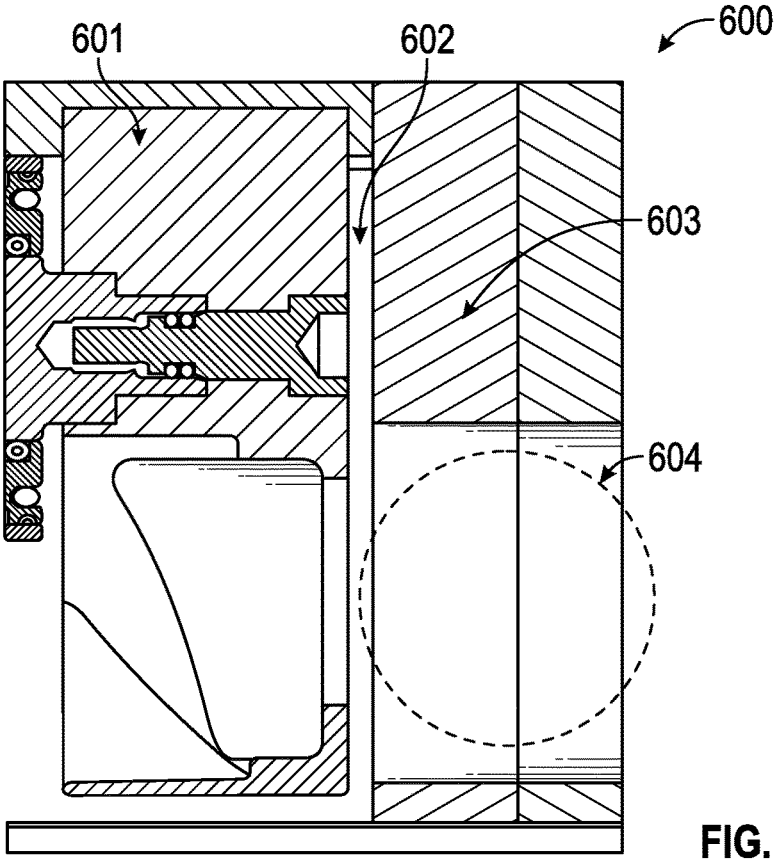
FIG. 6 represents a profile view of a shear valve and valve gap according to embodiments of the invention.

Gap adjustments will be described utilizing a shear valve; however, one of skill in the art will realize that the same techniques may apply to other types of valves, including gate, globe, and poppet valves. Drilling tool 600 in FIG. 6 is illustrated with a profile view of the shear valve 601 and the orifice plate 603, including an orifice 604. Other orifices 604 may also be present. A gap 602 is shown between the shear valve 601 and the orifice plate 603. The gap 602 may be adjusted in order to vary the sensitivity of the shear valve 601 and the flow splits between the orifices 604. The valve gap 602 may be adjusted either manually, actively, or automatically to gain the desired sensitivity and flow splits. In some embodiments, a smaller valve gap results in greater shear valve sensitivity than a relatively larger valve gap. For example, a small gap of less than about 50 mm may result in a greater shear valve sensitivity than a gap of larger than about 100 mm.

Figure 7A:
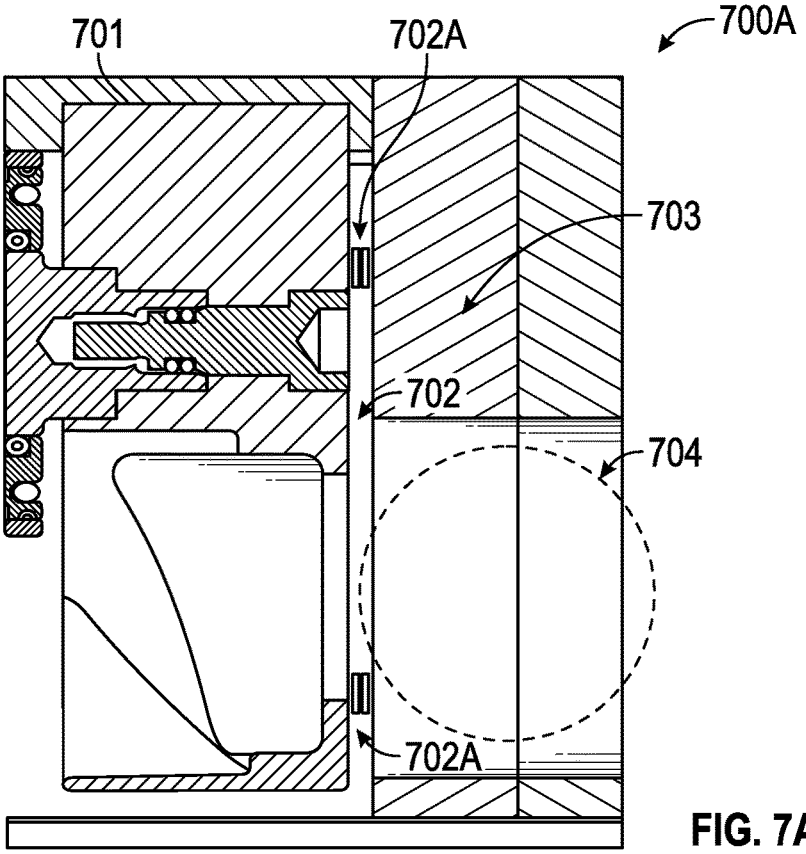
FIGS. 7A-C represent gap adjusting mechanisms according to embodiments of the disclosure.

Manual gap adjustment is illustrated in FIG. 7A. Drilling tool 700A includes shear valve 701 and orifice plate 703, which includes an orifice 704. Other orifices 704 may also be present. Valve gap 702 may be adjusted by utilizing shims 702A or other types of spacers. If a larger gap is desired, more shims 702A or larger shims may be used. If a smaller gap is desired, fewer shims 702A, or smaller shims 702A may be used.

Figure 7B:
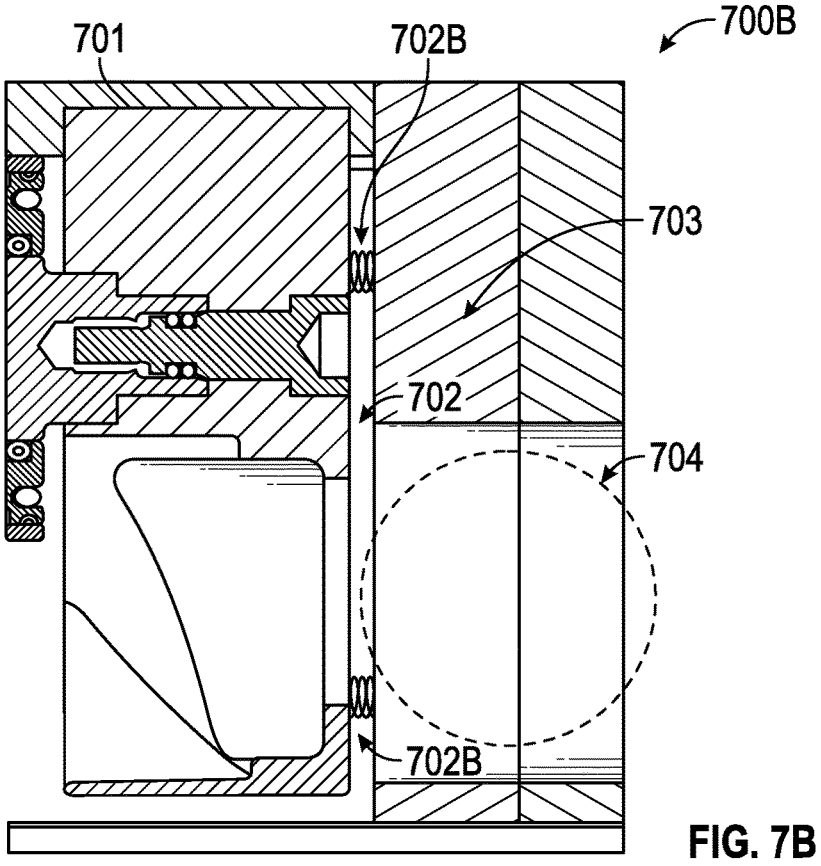

Active gap adjustment is illustrated in FIG. 7B. Active refers to a mechanical system that may adjust based on conditions, and does not necessarily rely on "smart" control electronics. Active adjustment may also be referred to as passive adjustment. Drilling tool 700B includes shear valve 701 and orifice plate 703, which includes an orifice 704. Other orifices 704 may also be present. Valve gap 702 may be passively adjusted by utilizing springs 702B or devices acting like springs, such as a folded piece of metal. Any type of spring known in the art may be used. If a larger gap is desired, stronger springs 702B or several springs 702B may be used. If a smaller gap is desired, weaker springs 702B, or fewer springs 702B may be used.

Figure 7C:
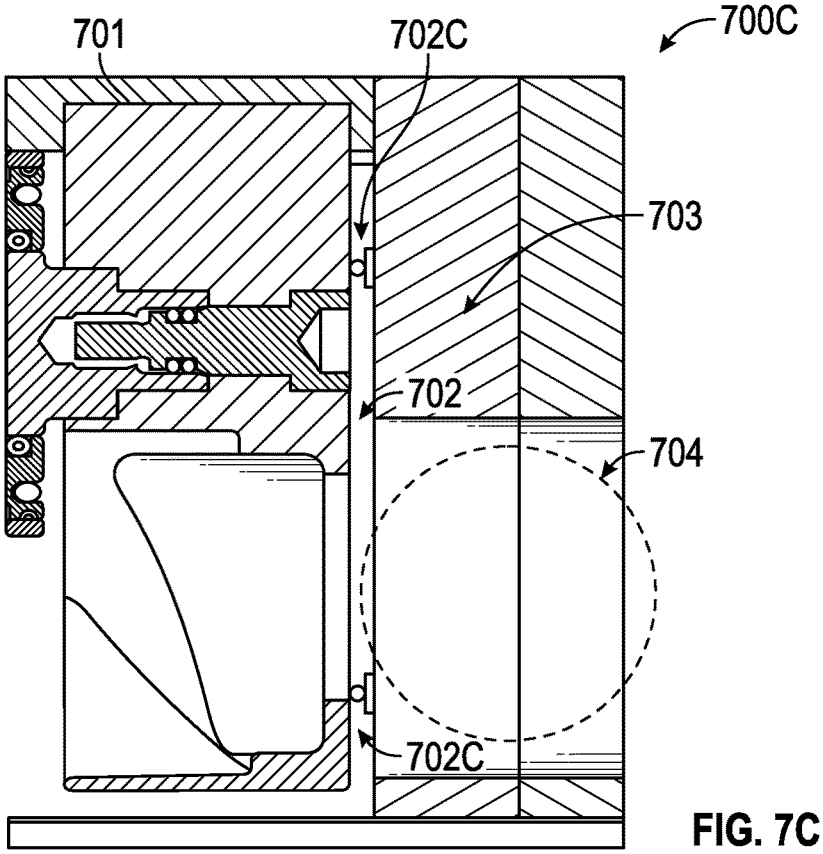

Automatic gap adjustment is illustrated in FIG. 7C. Drilling tool 700C includes shear valve 701 and orifice plate 703, which includes an orifice 704. Other orifices 704 may also be present. Valve gap 702 may be adjusted by utilizing actuators 702C. If a larger gap is desired, the actuators are triggered to open 702C. The actuators 702C may be adjustable between different widths, or may be "energized or de-energized" without incremental adjustments. If a smaller gap is desired, either the actuator 702C is de-energized, or the width may be adjusted. Any type of actuator known in the art may be used.

The invention having been generally described, the following example is given as an embodiment of the invention and to demonstrate the practice and advantages hereof. It is understood that the example is given by way of illustration and is not intended to limit the specification or the claims to follow in any manner.

EXAMPLE

Figure 8:
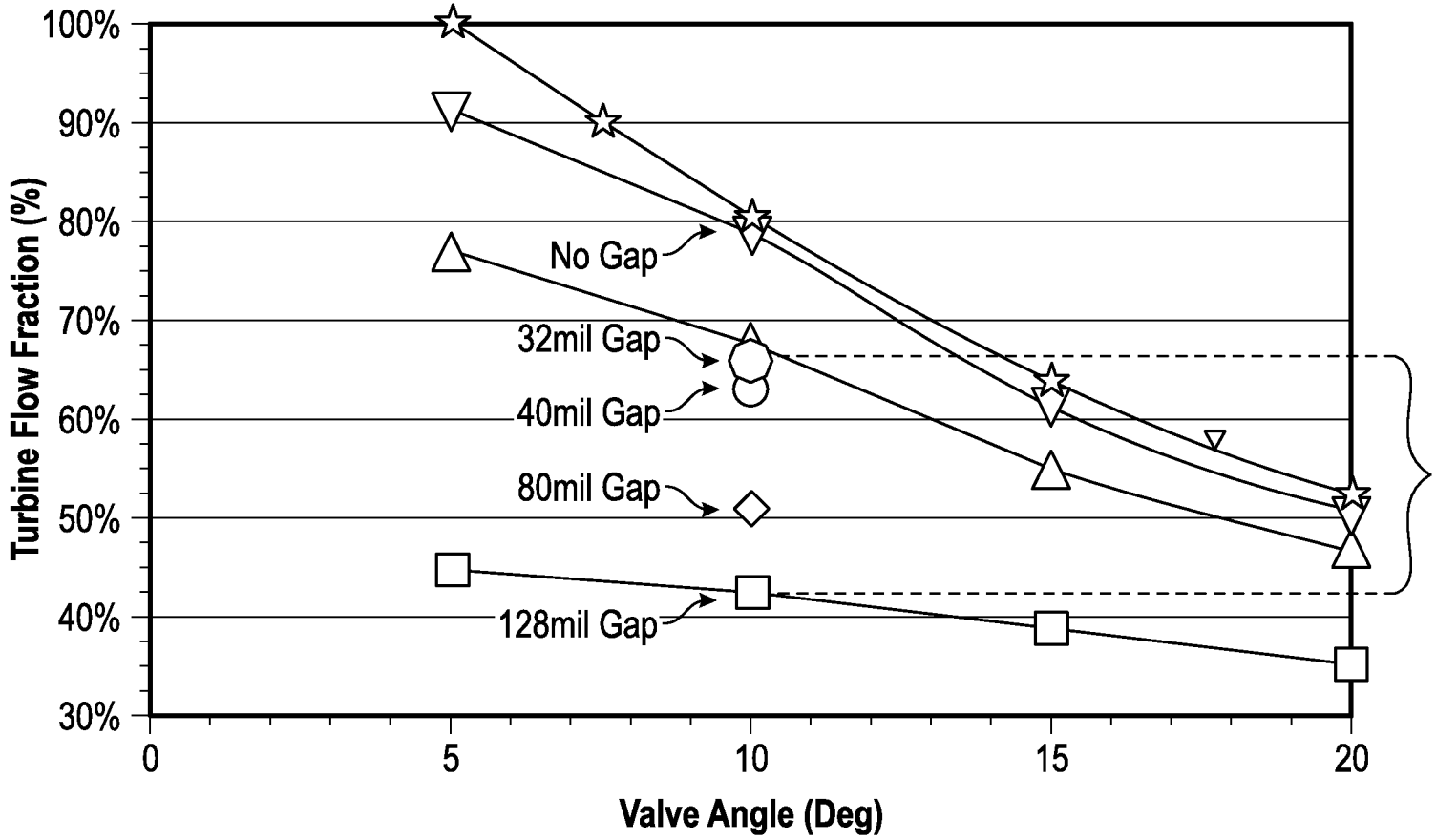
FIG. 8 is a graph depicting flow splits in the shear valve at various shear valve angles and valve gaps.

In a directional drilling tool, a shear valve may regulate the amount of mud flow to a turbine within the tool. The tool may operate with mud flow rates between 350 GPM and 650 GPM; however, the turbine may only require between 50 GPM and 200 GPM at all tool flow rates. Therefore, when pumping 650 GPM through the tool, the maximum flow the shear valve can be supplying to the turbine is 30% of the total flow, and when pumping 350 GPM, the shear valve needs to supply a maximum of 60% of the total flow to the turbine. Thus, to use the full rotation of the shear valve when pumping 650 GPM, a valve gap of roughly about 40 min is needed and greater than about 128 mm when pumping at 350 GPM. The relation between flow splits and valve gap is shown in FIG. 8. When using a small valve gap, such as about 32 mm, a change in valve angle, from 10 degrees and 15 degrees has an 11% change in flow fraction. However, when using a large valve gap, such as about 128 mm, a change in valve angle from 10 degrees and 15 degrees has an 4% change in flow fraction. Thus, a smaller valve gap increases the shear valve's sensitivity.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Embodiments disclosed herein include:

A: A downhole tool comprises a tool body, multiple orifices in the tool body defining at least a first and a second flow path, and a valve that adjusts to change a ratio of fluid flow between the first and second flow paths, the valve being offset from the multiple orifices by a gap that is adjustable to customize a sensitivity of the change to each adjustment.

B: A method for regulating flow along a first fluid path in a downhole tool, the method comprising adjusting a valve relative to multiple orifices that define the first fluid path and a second fluid path, said adjusting including changing a ratio of fluid flow between the first and second flow paths, and adjusting a gap between the valve and the multiple orifices to modify a sensitivity of the change.

C: A system for regulating flow along a first fluid path, the system comprising a downhole tool including: a valve coupled to multiple orifices that define the first fluid path and a second fluid path and a gap between the valve and the multiple orifices; said tool configured to adjust the valve relative to the multiple orifices, said adjustment including changing a ratio of fluid flow between the first and second flow paths; and adjust the gap between the valve and the multiple orifices to modify a sensitivity of the change.

Each of embodiments A, B and C may have one or more of the following additional elements in any combination: Element 1: further comprising a turbine, wherein the first path of the valve is in fluid communication with the turbine. Element 2: wherein the valve type is one selected from the group consisting of gate, shear, globe, and poppet. Element 3: wherein the valve type is a poppet valve. Element 4: wherein the gap is adjustable using at least one of a manual adjustment, an active adjustment, an automatic adjustment, and combinations thereof. Element 5: further comprising shims, wherein the shims are used to manually adjust the gap. Element 6: further comprising a spring, wherein the spring is used to passively adjust the gap. Element 7: further comprising an actuator, wherein the actuator is used to automatically adjust the gap. Element 8: wherein a smaller valve gap results in greater valve sensitivity than a relatively larger valve gap.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

The invention claimed is:

1. A downhole tool comprising:

a tool body defining a common single flow path for fluid flow;

multiple orifice openings located proximate one another in the tool body separating the common single flow path into at least a first flow path coupled to a fluid-controlled drive mechanism and a second flow path bypassing the fluid-controlled drive mechanism; and a valve located adjacent to at least one of the multiple orifice openings that adjusts to open and close the first flow path to change a ratio of the fluid flow between the first and second flow paths, the valve being offset from the at least one of the multiple orifice openings by a gap that is adjustable to customize a sensitivity of the change to each adjustment.

2. The tool of claim 1, wherein the fluid-controlled drive mechanism is a turbine.

3. The tool of claim 1, wherein the valve type is one selected from the group consisting of gate, shear, globe, and poppet.

4. The tool of claim 3, wherein the valve type is a poppet valve.

5. The tool of claim 1, wherein the gap is adjustable using at least one of a manual adjustment, an active adjustment, an automatic adjustment, and combinations thereof.

6. The tool of claim 5, further comprising shims, wherein the shims are used to manually adjust the gap.

7. The tool of claim 5, further comprising a spring, wherein the spring is used to passively adjust the gap.

8. The tool of claim 5, further comprising an actuator, wherein the actuator is used to automatically adjust the gap.

9. A method for regulating flow along a first fluid path in a downhole tool, the method comprising:

providing a downhole tool, the downhole tool including a tool body defining a common single flow path, multiple orifice openings located proximate one another in the tool body separating the common flow path into at least a first flow path coupled to a fluid-controlled drive mechanism and a second flow path bypassing the fluid-controlled drive mechanism, and a valve located adjacent to at least one of the multiple orifice openings;

adjusting the valve relative to the at least one of the multiple orifice openings that define the first fluid path and a second fluid path, said adjusting opening and closing the first flow path to change a ratio of fluid flow travelling down the common flow path between the first and second flow paths; and adjusting a gap between the valve and the at least one of the multiple orifice openings to modify a sensitivity of the change.

10. The method of claim 9, wherein the fluid-controlled drive mechanism is a turbine.

11. The method of claim 9, wherein the valve type is one selected from the group consisting of gate, shear, globe, and poppet.

12. The method of claim 11, wherein the valve type is a poppet valve.

13. The method of claim 9, wherein the gap is adjustable using at least one of a manual adjustment, an active adjustment, an automatic adjustment, and combinations thereof.

14. The method of claim 13, further comprising shims, wherein the shims are located in the gap to manually adjust the gap.

15. The method of claim 13, further comprising a spring, wherein the spring is located in the gap to passively adjust the gap.

16. The method of claim 13, further comprising an actuator, wherein the actuator located in the gap to automatically adjust the gap.

17. A system for regulating flow along a first fluid path, the system comprising:

a downhole tool comprising:

a tool body defining a common single flow path;

multiple orifice openings located proximate one another in the tool body separating the common single flow path into at least a first flow path coupled to a fluid-controlled drive mechanism and a second flow path bypassing the fluid-controlled drive mechanism;

a valve located adjacent to at least one of the multiple orifice openings; and a gap between the valve and the at least one of the multiple orifice openings;

said tool configured to:

adjust the valve relative to the at least one of the multiple orifice openings, said adjustment including opening and closing the first flow path to change a ratio of fluid flow between the first and second flow paths; and adjust the gap between the valve and the at least one of the multiple orifice openings to modify a sensitivity of the change.

18. The system of claim 17, wherein the fluid-controlled drive mechanism is a turbine.

* * * * *